US011590787B2

(12) United States Patent
Shuto et al.

(10) Patent No.: US 11,590,787 B2
(45) Date of Patent: Feb. 28, 2023

(54) REVERSIBLE RECORDING MEDIUM, REVERSIBLE RECORDING MEDIUM COATING, AND EXTERIOR MEMBER

(71) Applicant: Sony Corporation, Tokyo (JP)

(72) Inventors: Aya Shuto, Kanagawa (JP); Kenichi Kurihara, Kanagawa (JP); Yuriko Kaino, Kanagawa (JP)

(73) Assignee: Sony Corporation, Tokyo (JP)

( * ) Notice: Subject to any disclaimer, the term of this patent is extended or adjusted under 35 U.S.C. 154(b) by 512 days.

(21) Appl. No.: 16/349,822

(22) PCT Filed: Oct. 17, 2017

(86) PCT No.: PCT/JP2017/037527
§ 371 (c)(1),
(2) Date: May 14, 2019

(87) PCT Pub. No.: WO2018/092488
PCT Pub. Date: May 24, 2018

(65) Prior Publication Data

US 2019/0275820 A1 Sep. 12, 2019

(30) Foreign Application Priority Data

Nov. 17, 2016 (JP) ..... JP2016-223933

(51) Int. Cl.
*B41M 5/46* (2006.01)
*B41M 5/333* (2006.01)
(Continued)

(52) U.S. Cl.
CPC ..... *B41M 5/46* (2013.01); *B41M 5/305* (2013.01); *B41M 5/3275* (2013.01);
(Continued)

(58) Field of Classification Search
CPC .. B41M 5/305; B41M 5/3275; B41M 5/3335; B41M 5/3375; B41M 5/46; B41M 2205/04
See application file for complete search history.

(56) References Cited

U.S. PATENT DOCUMENTS

2006/0276335 A1 12/2006 Tsuboi et al.

FOREIGN PATENT DOCUMENTS

JP 2002240429 A 8/2002
JP 2004-168024 A 6/2004
(Continued)

OTHER PUBLICATIONS

International Search Report and Written Opinion issued in connection with International Patent Application No. PCT/JP2017/037527, dated Dec. 26, 2017. (10 pages).

*Primary Examiner* — Gerard Higgins
(74) *Attorney, Agent, or Firm* — K&L Gates LLP

(57) ABSTRACT

A reversible recording medium of an embodiment of the disclosure includes a support base, and a recording layer provided on the support base and reversibly changing between a recorded state and a deleted state. The recording layer includes a photothermal conversion material including one or more of a compound having a phthalocyanine skeleton, a compound having a squarylium skeleton, a compound having a cyanine skeleton including, in a molecule, one or both of a counter ion of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound; a coloring compound having an electron-donating property; and a color developing/quenching agent having an electron-accepting property and including at least one salicylic acid compound represented by the general formula (1) and including a linear hydrocarbon group having
(Continued)

25 to 34 carbon atoms via a linking group containing an amide moiety.

7 Claims, 8 Drawing Sheets

(51) Int. Cl.
*B41M 5/30* (2006.01)
*B41M 5/337* (2006.01)
*B41M 5/327* (2006.01)

(52) U.S. Cl.
CPC ..... *B41M 5/3335* (2013.01); *B41M 5/3375* (2013.01); *B41M 2205/04* (2013.01)

(56) References Cited

FOREIGN PATENT DOCUMENTS

| | | | |
|---|---|---|---|
| JP | 2005-028770 | A | 2/2005 |
| JP | 2005-028788 | A | 2/2005 |
| JP | 2005-066936 | A | 3/2005 |
| JP | 2005-153156 | A | 6/2005 |
| JP | 2005-238746 | A | 9/2005 |
| JP | 2014-172185 | A | 9/2014 |

[ FIG. 1 ]
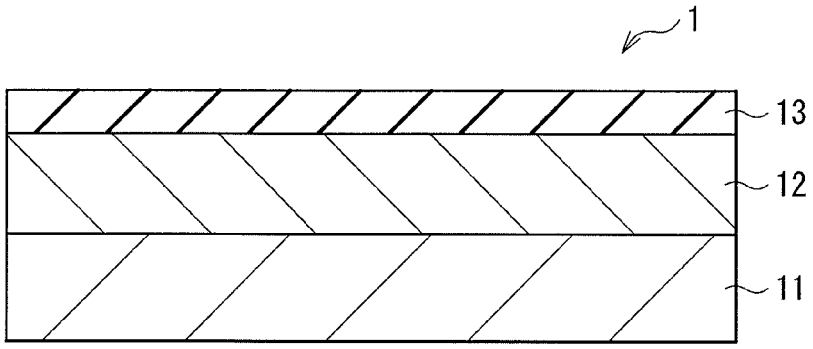
[ FIG. 2 ]
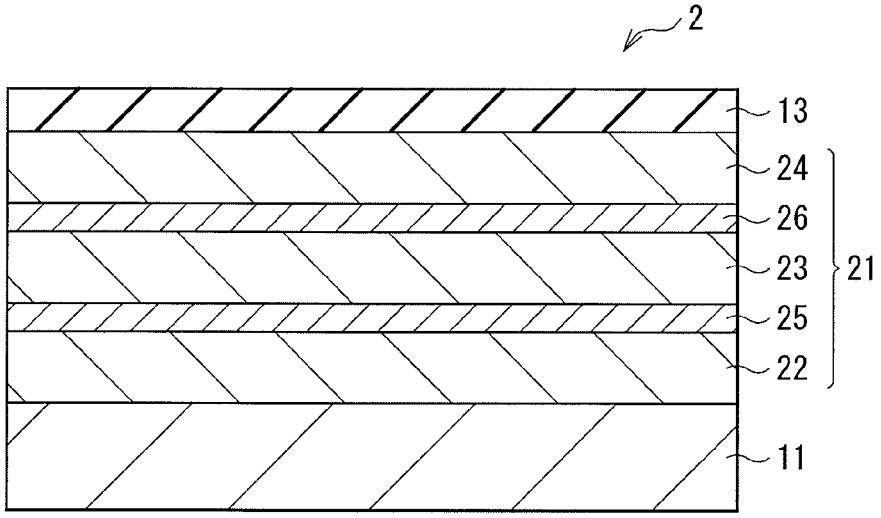
[ FIG. 3 ]
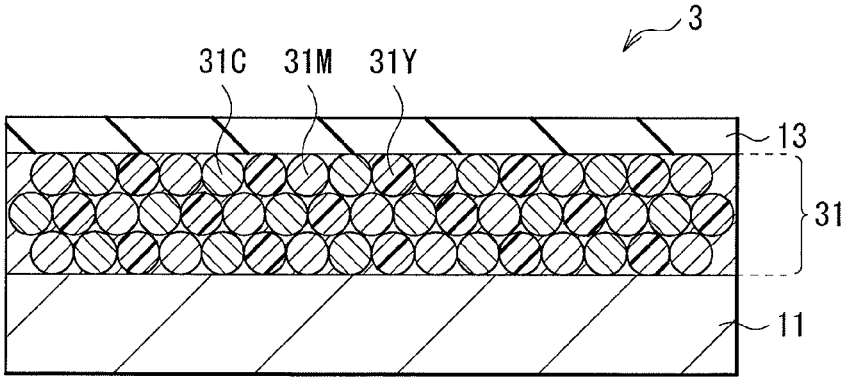

[ FIG. 4 ]
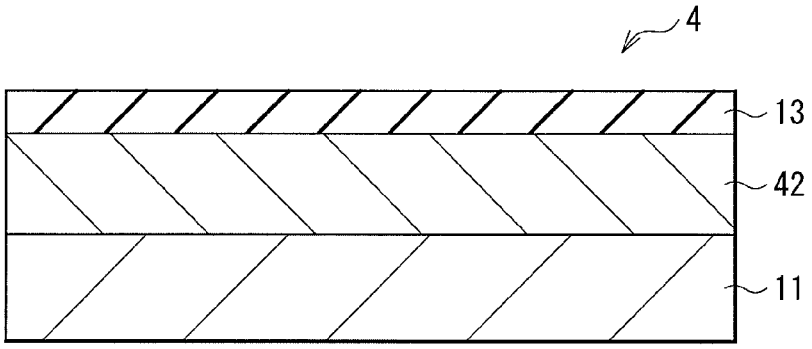

[ FIG. 5A ]
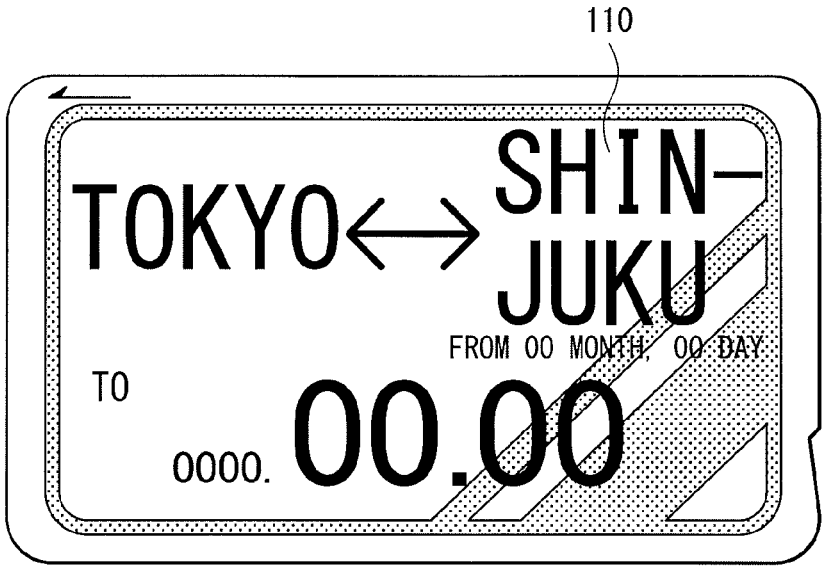
[ FIG. 5B ]
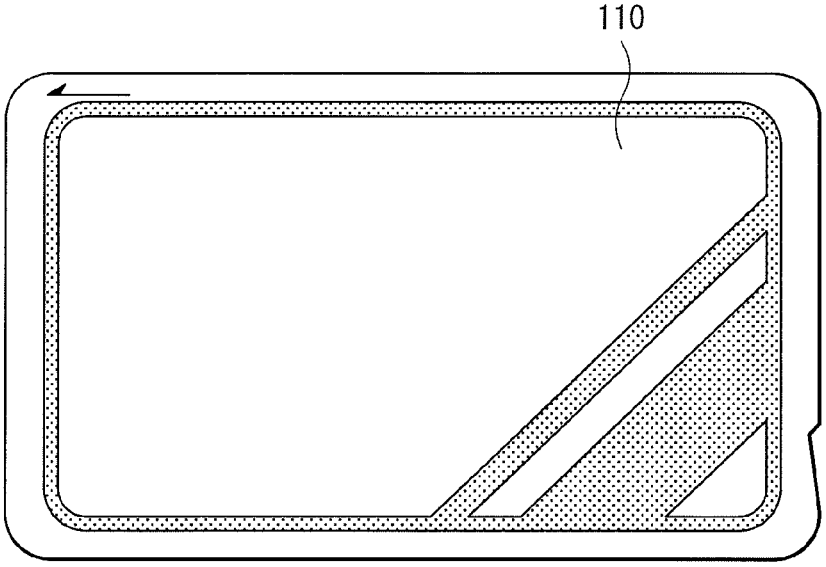

[ FIG. 6A ]
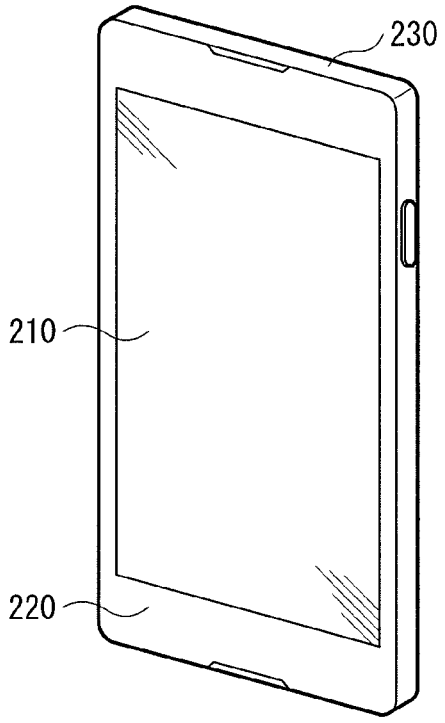
[ FIG. 6B ]
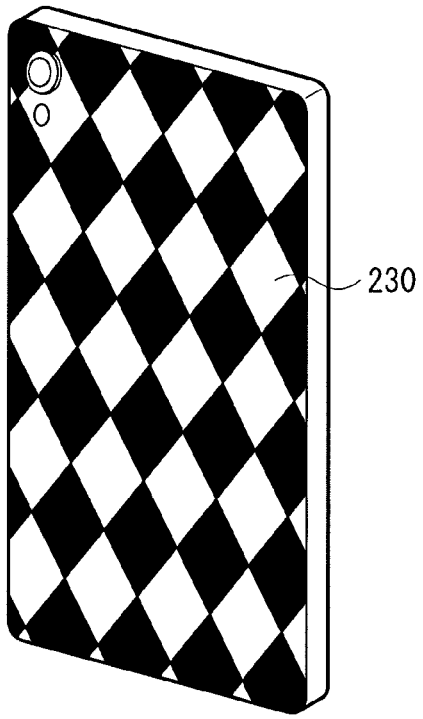

[ FIG. 7A ]
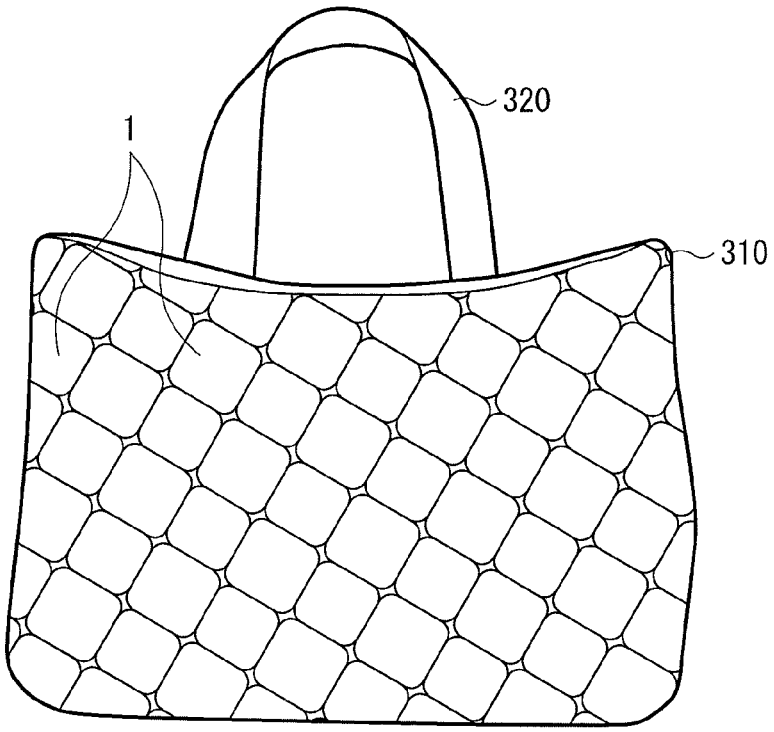
[ FIG. 7B ]
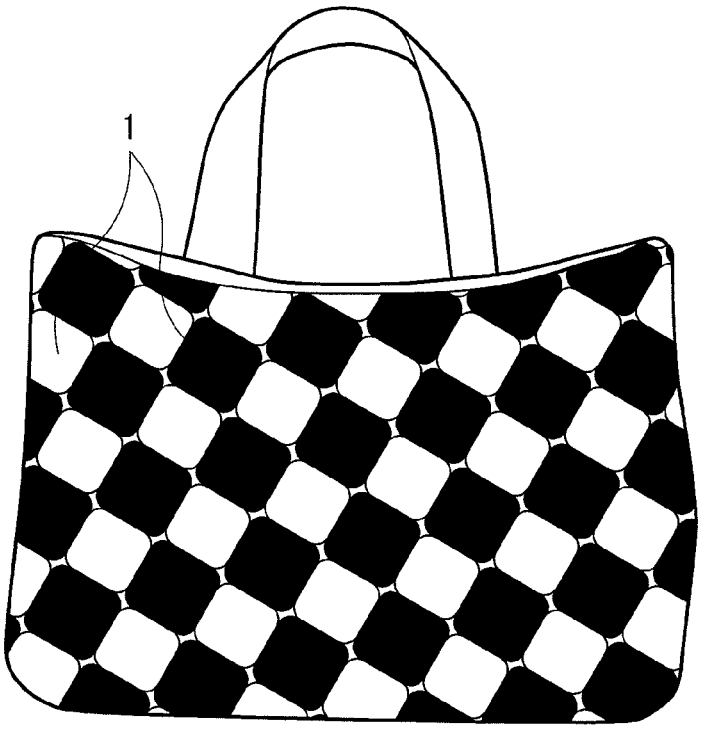

[ FIG. 8 ]
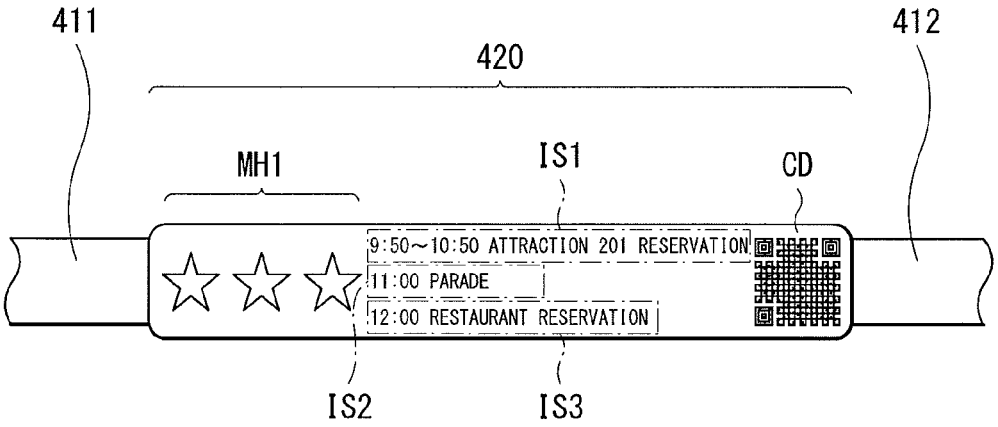

[ FIG. 9 ]
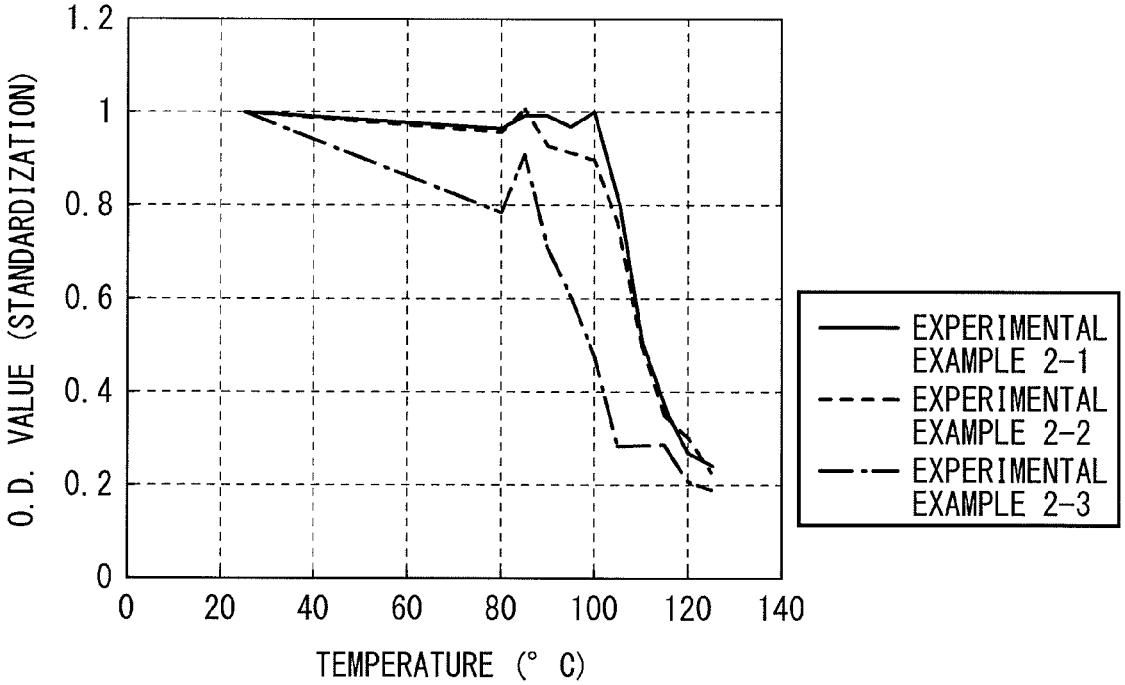
[ FIG. 10 ]
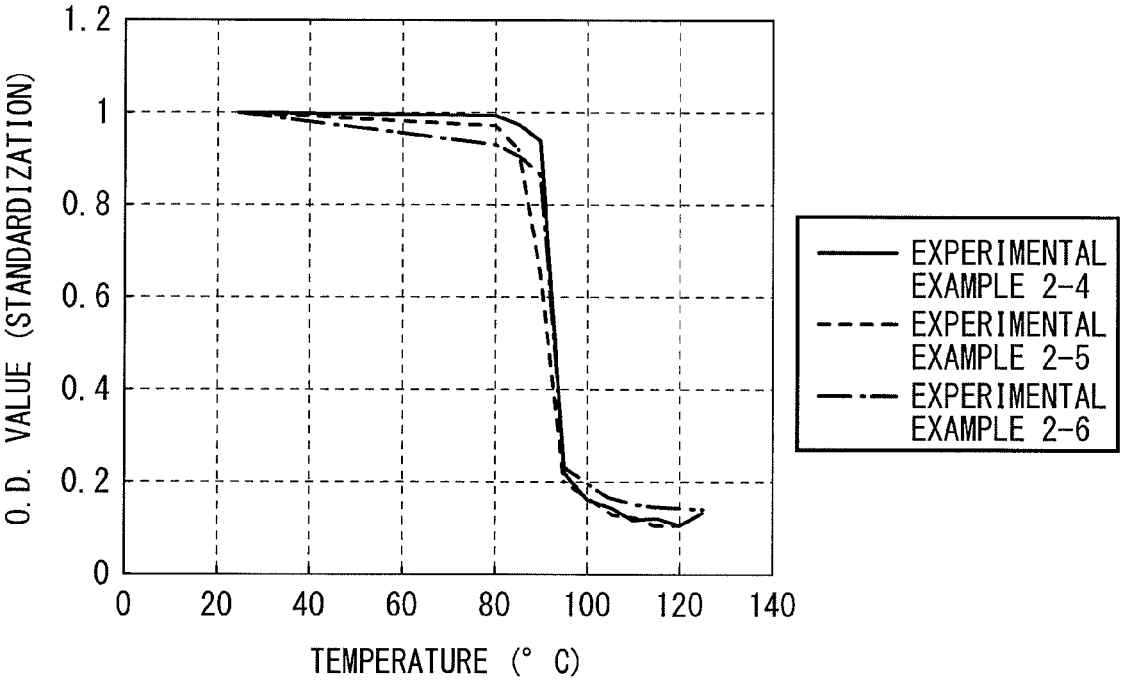

[ FIG. 11 ]
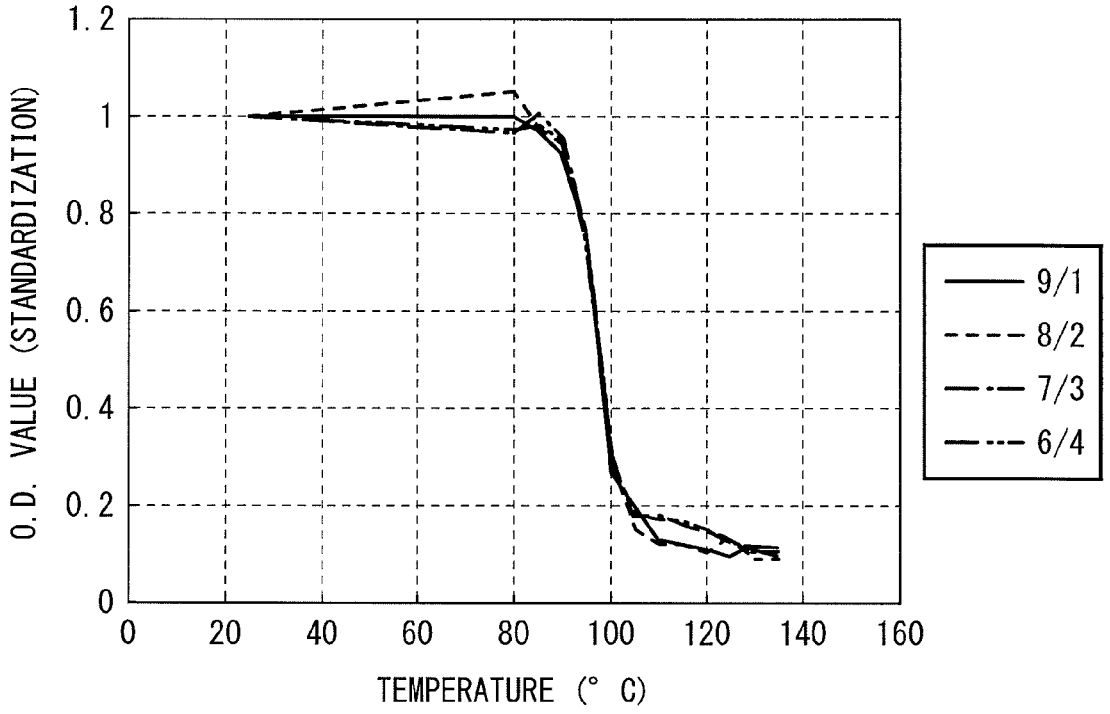

REVERSIBLE RECORDING MEDIUM, REVERSIBLE RECORDING MEDIUM COATING, AND EXTERIOR MEMBER

CROSS-REFERENCE TO RELATED APPLICATIONS

The present application claims the benefit of International Application No. PCT/JP2017/037527, filed Oct. 17, 2017, which claims priority to Japanese Application No. 2016-223933, filed Nov. 17, 2016, the disclosures of which are incorporated herein by reference.

BACKGROUND

The present disclosure relates to a reversible recording medium that allows for image recording and image deletion, a reversible recording medium coating, and an exterior member provided therewith.

Recently, necessity of a rewritable recording technique has been recognized from the viewpoint of global environment. For example, development has been in progress in a recording medium that enables information to be recorded and deleted reversibly by heat, i.e., a so-called reversible recording medium, as an example of a display medium that replaces a printed matter.

The reversible recording medium is typically configured by a coloring compound having an electron-donating property, a color developing/quenching agent having an electron-accepting property, and a matrix polymer. Meanwhile, for example, PTL 1 discloses a reversible multicolor recording medium having color-developing sensitivity that is enhanced with use of a salicylic-based compound as the color developing/quenching agent. The reversible multicolor recording medium includes a plurality of stacked recording layers. The recording layers each include a cyanine-based photothermal conversion material in addition to the above-described materials. This makes it possible to selectively change a color hue of a desired recording layer by irradiation with light of a specific wavelength.

SUMMARY

Incidentally, a reversible recording medium is requested to have color development stability and repeated drawability.

It is desirable to provide a reversible recording medium, a reversible recording medium coating, and an exterior member that make it possible to enhance color development stability and repeated drawability while maintaining color development sensitivity.

A reversible recording medium according to an embodiment of the present disclosure includes a support base, and a recording layer provided on the support base and reversibly changing between a recorded state and a deleted state. The recording layer includes a photothermal conversion material including one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound; a coloring compound having an electron-donating property; and a color developing/quenching agent having an electron-accepting property and including at least one compound represented by the following general formula (1).

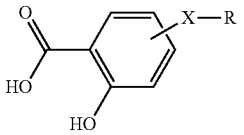

(1)

where X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 25 to 34 carbon atoms.

A reversible recording medium coating according to an embodiment of the present disclosure includes: in a solvent, a photothermal conversion material including one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound; a coloring compound having an electron-donating property; and a color developing/quenching agent having an electron-accepting property and including at least one compound represented by the above general formula (1).

An exterior member according to an embodiment of the present disclosure has at least one surface that is provided with the above-described reversible recording medium according to an embodiment of the present disclosure.

In the reversible recording medium, the reversible recording medium coating, and the exterior member of respective embodiments of the present disclosure, the coloring compound having an electron-donating property and the color developing/quenching agent including at least one compound represented by the above general formula (1) are used as materials of the recording layer. Further, the photothermal conversion material is used, which includes one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound. This makes it possible to enhance heat resistance of the recording layer.

According to the reversible recording medium, the reversible recording medium coating, and the exterior member of respective embodiments of the present disclosure, at least one compound represented by the above general formula (1) is used as the color developing/quenching agent that constitutes the recording layer. Further, one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound are used as the photothermal conversion material. This makes it possible to enhance color development stability and repeated drawability while maintaining color development sensitivity.

It is to be noted that the effects described here are not necessarily limitative, and may be any of the effects described in the present disclosure.

BRIEF DESCRIPTION OF DRAWINGS

FIG. 1 is a cross-sectional view of an example of a configuration of a reversible recording medium according to a first embodiment of the present disclosure.

FIG. 2 is a cross-sectional view of an example of a configuration of a reversible recording medium according to a second embodiment of the present disclosure.

FIG. 3 is a cross-sectional view of an example of a configuration of a reversible recording medium according to a modification example of the present disclosure.

FIG. 4 is a cross-sectional view of an example of a configuration of a reversible recording medium according to a third embodiment of the present disclosure.

FIG. 5A is a perspective view of an example of an appearance of Application Example 1.

FIG. 5B is a perspective view of another example of the appearance of Application Example 1.

FIG. 6A is a perspective view of an example of an appearance of Application Example 2.

FIG. 6B is a perspective view of another example of the appearance of Application Example 2.

FIG. 7A is a perspective view of an example of an appearance (front side) of Application Example 3.

FIG. 7B is a perspective view of an example of an appearance (rear side) of Application Example 3.

FIG. 8 is an explanatory diagram illustrating a configuration example of Application Example 4.

FIG. 9 is a characteristic diagram illustrating a relationship between a temperature and an O.D. value in each of Experimental Examples 2-1 to 2-3.

FIG. 10 is a characteristic diagram illustrating a relationship between a temperature and an O.D. value in each of Experimental Examples 2-4 to 2-6.

FIG. 11 is a characteristic diagram illustrating a relationship between a temperature and an O.D. value in a case where two types of leuco pigments are mixed arbitrarily.

DETAILED DESCRIPTION

In the following, some embodiments of the present disclosure are described in detail with reference to the drawings. It is to be noted that the following description is directed to specific examples of the present disclosure, and the present disclosure is not limited to the following embodiments. The description is given in the following order.

1. First Embodiment (An example of a reversible recording medium including a color developing/quenching agent having a salicylic acid skeleton)
   1-1. Configuration of Reversible Recording Medium
   1-2. Manufacturing Method of Reversible Recording Medium
   1-3. Recording and Deletion Methods of Reversible Recording Medium
   1-4. Workings and Effects
2. Second Embodiment (An example of a reversible recording medium including a plurality of recording layers)
   2-1. Configuration of Reversible Recording Medium
   2-2. Recording and Deletion Methods of Reversible Recording Medium
   2-3. Workings and Effects
3. Modification Examples
   3-1. Modification Example 1 (An example of a reversible recording medium that enables multicolor display using a single-layer recording layer)
   3-2. Modification Example 2 (An example in which a plurality of types of coloring compounds are mixed to form a recording layer)
4. Third Embodiment (An example of using a compound having a phthalide skeleton as a coloring compound)
   4-1. Configuration of Reversible Recording Medium
   4-2. Workings and Effects
5. Application Examples
6. Working Examples

1. First Embodiment

FIG. 1 illustrates a cross-sectional configuration of a reversible recording medium (a reversible recording medium 1) according to a first embodiment of the present disclosure. The reversible recording medium 1 includes, for example, a recording layer 12 that is disposed on a support base 11 and allows for reversible change between a recorded state and a deleted state. It is to be noted that FIG. 1 schematically illustrates the cross-sectional configuration of the reversible recording medium 1 and that the size and shape thereof may be different from the actual size and shape thereof in some cases.

(1-1. Configuration of Reversible Recording Medium)

The support base 11 serves to support the recording layer 12. The support base 11 is configured by a material having superior heat resistance as well as superior size stability in a planar direction. The support base 11 may have a property of either light-transmissivity or non-light-transmissivity. For example, the support base 11 either may be a substrate having rigidity, such as a wafer, or may be configured by flexible thin layer glass, film, paper, or the like. The use of a flexible substrate as the support base 11 allows for achievement of a flexible (foldable) reversible recording medium.

Examples of a constituent material of the support base 11 include an inorganic material, a metal material, and a macromolecular material such as plastic. Specific examples of the inorganic material include silicon (Si), silicon oxide ($SiO_x$), silicon nitride ($SiN_x$), and aluminum oxide ($AlO_x$). Examples of silicon oxide include glass and spin-on-glass (SOG). Examples of the metal material include aluminum (Al), nickel (Ni), and stainless steel. Examples of the macromolecular material include polycarbonate (PC), polyethylene terephthalate (PET), polyethylene naphthalate (PEN) or polyethyl ether ketone (PEEK), polyvinyl chloride (PVC), and copolymers thereof It is to be noted that an upper surface or a lower surface of the support base 11 is preferably provided with a reflective layer (unillustrated). The provision of the reflective layer allows for more vivid color display.

The recording layer 12 enables information to be recorded and deleted reversibly by heat. The recording layer 12 is configured by a material that allows for stable repeated recording and allows for control of a decolored state and a color-developed state. Specifically, the recording layer 12 includes a coloring compound, a color developing/quenching agent, and a photothermal conversion material, and is formed, for example, by a macromolecular material. The recording layer 12 has a thickness in a range from 1 μm to 10 μm, for example.

Examples of the coloring compound include a leuco pigment. Examples of the leuco pigment include existing dye for heat-sensitive paper. A specific example thereof includes a compound that contains, in a molecule, a group having an electron-donating property and is represented by the following formula (2-1).

(2-1)

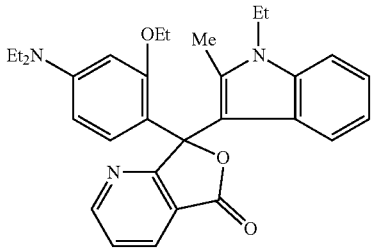

The color developing/quenching agent serves, for example, to develop a color of a colorless coloring compound or to decolor a coloring compound colored in a predetermined color. Examples of the color developing/quenching agent include a compound having a salicylic acid skeleton represented by the following general formula (1) and containing, in a molecule, a group having an electron-accepting property.

(1)

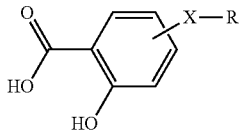

(X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO—, and —CONHNHCONH—. R is a linear hydrocarbon group having 25 to 34 carbon atoms.)

The photothermal conversion material serves, for example, to absorb light in a predetermined wavelength region of a near infrared region to generate heat. It is preferable to use, as the photothermal conversion material, for example, a near infrared-absorbing pigment that has an absorption peak in a wavelength in a range from 700 nm to 2,000 nm and hardly has absorption in a visible region. Specific examples thereof include a compound having a phthalocyanine skeleton (a phthalocyanine-based dye), a compound having a squarylium skeleton (a squarylium-based dye), and an inorganic compound. Examples of the inorganic compound include a metal complex such as a dithio complex, a diimmonium salt, an aminium salt, and an inorganic compound. Examples of the inorganic compound include metal oxides such as graphite, carbon black, metal powder particles, tricobalt tetroxide, iron oxide, chromium oxide, copper oxide, titanium black and ITO, metal nitrides such as niobium nitride, metal carbides such as tantalum carbide, metal sulfides, and various magnetic powders. Aside from those described above, a compound having a cyanine skeleton (a cyanine-based dye) with superior light resistance and superior heat resistance may be used. As used herein, the superior light resistance refers to not dissolving during laser irradiation. The superior heat resistance means that a change equal to or more than 20% does not occur to a maximum absorption peak value of an absorption spectrum when being formed as a film together with a macromolecular material, for example, and being stored at 150° C. for 30 minutes, for example. Examples of such a compound having a cyanine skeleton include a compound containing, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring. It is to be noted that, although the compound having a cyanine skeleton to be used for the reversible recording medium according to the present embodiment is preferably provided with both of one of the above-mentioned counter ions and a ring structure such as a five-membered ring and a six-membered ring in a methine chain, the provision of at least one of those allows sufficient light resistance and heat resistance to be secured.

As the macromolecular material, it is preferable to adopt a material in which the coloring compound, the color developing/quenching agent, and the photothermal conversion material are easily dispersed evenly. Examples of the macromolecular material include a thermosetting resin and a thermoplastic resin. Specific examples thereof include polyvinyl chloride, polyvinyl acetate, a vinyl chloride-vinyl acetate copolymer, ethyl cellulose, polystyrene, a styrene-based copolymer, a phenoxy resin, polyester, aromatic polyester, polyurethane, polycarbonate, a polyacrylic ester, a polymethacrylic ester, an acrylic-based copolymer, a maleic acid-based polymer, polyvinyl alcohol, modified polyvinyl alcohol, hydroxy ethyl cellulose, carboxymethyl cellulose, and starch.

The recording layer 12 includes at least one of the coloring compounds, at least one of the color developing/quenching agents, and at least one of the photothermal conversion materials. It is preferable for the coloring compound and the color developing/quenching agent included in the recording layer 12 to have a ratio between the coloring compound and the color developing/quenching agent being equal to 1:2 (weight ratio), for example. The photothermal conversion agent is changed depending on the thickness of the recording layer 12. Further, the recording layer 12 may include, in addition to the above-mentioned materials, various additives such as a sensitizer and an ultraviolet absorbing agent, for example.

A protective layer 13, for example, may be formed on the recording layer 12. The protective layer 13 serves to protect a surface of the recording layer 12, and is formed using an ultraviolet curable resin or a thermosetting resin, for example. The protective layer 13 has a thickness in a range from 0.1 μm to 20 μm, for example.

(1-2. Manufacturing Method of Reversible Recording Medium)

The reversible recording medium 1 according to the present embodiment may be manufactured using an application method, for example. It is to be noted that the manufacturing method described below is merely exemplary; any other method may be used for the manufacture.

First, for example, a vinyl chloride/vinyl acetate copolymer is dissolved as a macromolecular material into a solvent (e.g., methyl ethyl ketone). A color developing/quenching agent, a coloring compound, and a photothermal conversion material are added to the solution, and dispersed therein. This allows for obtainment of a reversible recording medium coating. Subsequently, the reversible recording medium coating is applied onto the support base 11 to have a thickness of 3 μm, for example, and is dried at 70° C., for example, to form the recording layer 12. Next, an acrylic resin, for example, is applied onto the recording layer 12 to have a thickness of 10 μm, for example, and thereafter is dried to form the protective layer 13. The above allows for completion of the reversible recording medium 1 illustrated in FIG. 1.

It is to be noted that a method other than the above-described application may be used to form the recording layer 12. For example, a film obtained by application to another base material beforehand may be adhered onto the support base 11 via an adhesive film, for example, to form the recording layer 12. Alternatively, the support base 11 may be immersed in the coating to form the recording layer 12.

(1-3. Recording and Deletion Methods of Reversible Recording Medium)

In the reversible recording medium 1 according to the present embodiment, recording and deletion may be performed as follows, for example.

First, the recording layer 12 is heated at a temperature enough to decolor a coloring compound, e.g., at 120° C., to cause the recording layer 12 to be in a decolored state in advance. Next, a desired position of the recording layer 12 is irradiated with a near infrared ray having a wavelength and an output that are adjusted using, for example, a semiconductor laser, etc. This allows for heating of the photothermal conversion material included in the recording layer 12, causing a coloring reaction (chromogenic reaction) between the coloring compound and the color developing/quenching agent, thus allowing the irradiated part to develop a color.

Meanwhile, in a case where a color-developed part is decolored, irradiation is performed with an infrared ray at energy enough to cause the color-developed part to reach a decoloring temperature. This allows for heating of the photothermal conversion material included in the recording layer 12, causing a decoloring reaction between the coloring compound and the color developing/quenching agent, thus allowing the irradiated part to be decolored and leading to deletion of a record. Further, in a case of deleting all of records formed in the recording layer 12 all at once, the reversible recording medium 1 is heated at a temperature enough to perform decoloring, e.g., at 120° C. This allows information recorded in the recording layer 12 to be deleted all at once. Thereafter, the above-described operation is performed, thus enabling repeated recording into the recording layer 12.

It is to be noted that the color-developed state and the decolored state are kept insofar as the above-described chromogenic reaction and decoloring reaction such as the near infrared irradiation and the heating are not performed.

(1-4. Workings and Effects)

As described above, development has been in progress in a display medium that replaces a printed matter. As one of the display medium, a reversible recording medium has attracted attention, which allows information to be recorded and deleted reversibly by heat. The reversible recording medium is typically configured by the coloring compound having an electron-donating property, the color developing/quenching agent having an electron-accepting property, and a matrix polymer. Further, addition of the photothermal conversion material and irradiation with light of a specific wavelength enable the reversible recording medium to perform recording and deletion.

The reversible recording medium is conceived to be applied to, in addition to printing on an IC card, a label, or the like, for example, decoration of a surface of a casing of an electronic apparatus, etc., or an interior, an exterior, or the like of a building. Accordingly, the reversible recording medium is requested to have durability, in particular, weather resistance. The weather resistance refers to a "property less likely to change in the outdoors while resisting actions of nature such as sunlight, wind and rain, dew and frost, coldness and hotness, and dryness".

Among the above-mentioned circumstances, humidity and wetness such as wind and rain, dew and frost, and dryness are able to be coped with, for example, by forming a moisture-resistant protective film or an equivalent thereof on a surface of the reversible recording medium. Further, sunlight is able to be coped with, for example, by forming an ultraviolet absorbing protective film on the surface of the reversible recording medium. As for coldness and hotness (temperature), however, the reversible recording medium itself is requested to have durability (color development stability for a long period of time).

In the reversible recording medium, a phenol-based compound is typically used as the color developing/quenching agent; an attempt has been made to enhance the color development stability by developing a new phenol-based compound. Further, in the above-described reversible recording medium disclosed in PTL 1, a salicylic-based compound is used as the color developing/quenching agent to achieve enhancement of color-developing sensitivity. In this reversible recording medium, further use of a photothermal conversion material makes it possible to selectively change a color hue of a specific recording layer of a plurality of stacked recording layers.

In the above-described reversible recording medium, however, although it is possible to perform recording (color development) at the first time, it is difficult to perform recording at the second time or later after deletion (decoloring); it is requested to enhance performance of repeated drawability.

In contrast, in the reversible recording medium 1 according to the present embodiment, the coloring compound having an electron-donating group, the color developing/quenching agent having the salicylic acid skeleton represented by the above general formula (1) and having the linear hydrocarbon group having 25 to 34 carbon atoms at R, and the photothermal conversion material of one of a compound having a phthalocyanine skeleton, a compound having a squarylium skeleton, and an inorganic compound are used to configure the recording layer 12. This makes it possible to enhance heat resistance of the recording layer 12, e.g., resistance to high temperature (e.g., higher than 200° C.) during laser irradiation at the time of recording and at the time of deletion.

As described above, the reversible recording medium 1 according to the present embodiment involves using, as the color developing/quenching agent that configures the recording layer 12, a compound having the salicylic acid skeleton represented by the above general formula (1) and having the linear hydrocarbon group having 25 to 34 carbon atoms at R. Further, one of the compound having a phthalocyanine skeleton, the compound having a squarylium skeleton, and the inorganic compound is used as the photothermal conversion material. This allows for enhancement of heat resistance of the recording layer 12 while maintaining the color-developing sensitivity. Specifically, it becomes possible, for example, to enhance the resistance to high temperature (e.g., higher than 200° C.) during laser irradiation at the time of recording (drawing) and at the time of deletion and thus to enhance the property of repeated drawability. Further, it becomes possible, for example, to enhance the color development stability at the time of storing at high temperature (e.g., 60° C.).

Next, description is given of second and third embodiments and Modification Examples 1 and 2 of the present disclosure. In the following, components similar to those of the foregoing first embodiment are denoted by the same reference numerals, and descriptions thereof are omitted where appropriate.

2. Second Embodiment

FIG. 2 illustrates a cross-sectional configuration of a reversible recording medium (a reversible recording medium 2) according to a second embodiment of the present disclosure. The reversible recording medium 2 includes, for example, a recording layer 21 that is disposed on the support base 11 and allows for reversible change between a recorded state and a deleted state. The recording layer 21 includes, for example, three layers (a first layer 22, a second layer 23, and a third layer 24) that are stacked in this order. Heat-insulating layers 25 and 26 are provided, respectively, between the layers 22 and 23 and between the layers 23 and 24. It is to be noted that FIG. 2 schematically illustrates the cross-sectional configuration of the reversible recording medium 1 and that the size and shape thereof may be different from the actual size and shape thereof in some cases.

(2-1. Configuration of Reversible Recording Medium)

The recording layer 21 is able to record and delete information reversibly by heat, and has a configuration in which, for example, the first layer 22, the second layer 23, and the third layer 24 are stacked in this order from side of the support base 11, as described above. The first layer 22, the second layer 23, and the third layer 24 include respective coloring compounds that are colored differently from one another, color developing/quenching agents corresponding to the respective coloring compounds, and photothermal conversion materials that absorbs light in wavelength regions different from one another to generate heat; the first layer 22, the second layer 23, and the third layer 24 are each formed by a macromolecular material, for example. As described above, the color developing/quenching agent serves, for example, to develop a color of a colorless coloring compound or to decolor a coloring compound colored in a predetermined color. The color developing/quenching agent is selected, for example, from compounds having the salicylic acid skeleton represented by the above general formula (1) and containing, in a molecule, a group having an electron-accepting property. As described above, the photothermal conversion material is selected from the compound having a phthalocyanine skeleton (the phthalocyanine-based dye), the compound having a squarylium skeleton (the squarylium-based dye), the inorganic compound, and the like. Aside from those described above, the compound having a cyanine skeleton (the cyanine-based dye) with superior light resistance and superior heat resistance may be used, similarly to the foregoing first embodiment.

Specifically, the first layer 22 includes, for example, a coloring compound that develops a cyan color, a color developing/quenching agent corresponding to the coloring compound, and a photothermal conversion material that absorbs an infrared ray of a wavelength $\lambda_1$, for example, to be colored. The second layer 23 includes, for example, a coloring compound to be colored in a magenta color, a color developing/quenching agent corresponding to the coloring compound, and a photothermal conversion material that absorbs an infrared ray of a wavelength $\lambda_2$, for example, to generate heat. The third layer 24 includes, for example, a coloring compound to be colored in a yellow color, a color developing/quenching agent corresponding to the coloring compound, and a photothermal conversion material that absorbs an infrared ray of a wavelength $\lambda_3$, for example, to generate heat. This allows for obtainment of a display medium that enables multicolor display.

It is to be noted that it is preferable to select, for the photothermal conversion materials, a combination of materials having narrow photoabsorption bands that do not overlap one another in a range from 700 nm to 2,000 nm, for example. This makes it possible to selectively color or decolor a desired layer of the first layer 22, the second layer 23, and the third layer 24.

The first layer 22, the second layer 23, and the third layer 24 each have a thickness preferably in a range from 1 μm to 20 μm, for example, and more preferably in a range from 2 μm to 15 μm, for example. One reason for this is that, when the layers 22, 23, and 24 each have a thickness less than 1 μm, there is a possibility that sufficient color development density may not be obtained. Further, another reason for this is that, when the layers 22, 23, and 24 each have a thickness more than 20 μm, there is a possibility that a color-developing property and a decoloring property may be deteriorated due to larger amount of heat utilization of each of the layers 22, 23, and 24.

Further, similarly to the above-described recording layer 12, the first layer 22, the second layer 23, and the third layer 24 each include, in addition to the above-mentioned materials, various additives such as a sensitizer and an ultraviolet absorbing agent, for example.

Moreover, in the recording layer 21 according to the present embodiment, the heat-insulating layers 25 and 26 are provided, respectively, between the first layer 22 and the second layer 23 and between the second layer 23 and the third layer 24. The heat-insulating layers 25 and 26 are each configured, for example, using a typical macromolecular material having translucency. Specific examples of the material include polyvinyl chloride, polyvinyl acetate, a vinyl chloride-vinyl acetate copolymer, ethyl cellulose, polystyrene, a styrene-based copolymer, a phenoxy resin, polyester, aromatic polyester, polyurethane, polycarbonate, a polyacrylic ester, a polymethacrylic ester, an acrylic-based copolymer, a maleic acid-based polymer, polyvinyl alcohol, modified polyvinyl alcohol, hydroxy ethyl cellulose, carboxymethyl cellulose, and starch. It is to be noted that the heat-insulating layers 25 and 26 may each include various additives such as an ultraviolet absorbing agent, for example.

Further, the heat-insulating layers 25 and 26 may be each formed using an inorganic material having translucency. For example, use of porous silica, porous alumina, porous titania, porous carbon, a composite thereof, or the like brings preferable effects such as lower thermal conductivity as well as a higher heat-insulating effect. The heat-insulating layers 25 and 26 may be formed by a sol-gel method, for example.

The heat-insulating layers 25 and 26 each has a thickness preferably in a range from 3 μm to 100 μm, for example, and more preferably in a range from 5 μm to 50 μm, for example. One reason for this is that, when the heat-insulating layers 25 and 26 each has a too small thickness, a sufficient heat-insulating effect is not obtained, and, when having a too large thickness, thermal conductivity is deteriorated and translucency is lowered upon uniformly heating the entire reversible recording medium 2.

(2-2. Recording and Deletion Methods of Reversible Recording Medium)

It is possible for the reversible recording medium 2 according to the present embodiment to perform recording and deletion as follows, for example. It is to be noted that description is given here of the recording layer 21 by exemplifying a case where, as described above, the first layer 22, the second layer 23, and the third layer 24 to be colored, respectively, in the cyan color, the magenta color, and the yellow color are stacked.

First, heating is performed at a temperature enough to cause the recording layer 21 (the first layer 22, the second layer 23, and the third layer 24) to be decolored, e.g., at 120° C., and causes the recording layer 21 to be in a decolored state in advance. Next, an arbitrary part of the recording layer 21 is irradiated with an infrared ray having a wavelength and an output that are arbitrarily selected using, for example, a semiconductor laser, etc. Here, in a case where the first layer 22 is caused to develop a color, irradiation is performed with the infrared ray of the wavelength $\lambda_1$ at energy enough to cause the first layer 22 to reach a color-developing temperature. This allows for heating of the photothermal conversion material included in the first layer 22, causing a coloring reaction (chromogenic reaction) between the coloring compound and the color developing/quenching agent, thus allowing the irradiated part to develop the cyan color. Likewise, in a case where the second layer 23 is caused to develop a color, irradiation is performed with the infrared ray of the wavelength $\lambda_2$ at energy enough to cause the second layer 23 to reach a color-developing temperature. In a case where the third layer 24 is caused to develop a color, irradiation is performed with the infrared ray of the wavelength $\lambda_3$ at energy enough to cause the third layer 24 to reach a color-developing temperature. This allows for heating of each of the photothermal conversion materials included in the second layer 23 and the third layer 24, causing a coloring reaction between the coloring compound and the color developing/quenching agent, thus allowing the respective irradiated parts to develop the magenta color and the yellow color. In this manner, the irradiation of the respective arbitrary parts with the infrared rays of the corresponding wavelengths makes it possible to record information (e.g., a full-color image).

Meanwhile, in a case where the first layer 22, the second layer 23, and the third layer 24 subjected to the color development as described above are each decolored, irradiation is performed at energy enough to cause the infrared rays of the respective wavelengths corresponding to the layers 22, 23, and 24 to reach a decoloring temperature. This allows for heating of each of the photothermal conversion materials included in the first layer 22, the second layer 23, and the third layer 24, causing a decoloring reaction between the coloring compound and the color developing/quenching agent, thus allowing the irradiated part to be decolored and leading to deletion of a record. Further, in a case of deleting all of records formed in the recording layer 21 all at once, the recording layer 21 is heated at a temperature enough to decolor all of the first layer 22, the second layer 23, and the third layer 24, e.g., at 120° C. This allows information recorded in the recording layer 21 (the first layer 22, the second layer 23, and the third layer 24) to be deleted all at once. Thereafter, the above-described operation is performed, thus enabling repeated recording into the recording layer 21.

(2-3. Workings and Effects)

In the reversible recording medium 2 according to the present embodiment, for example, the three layers (the first layer 22, the second layer 23, and the third layer 24) are formed, which include the respective coloring compounds to be colored in the yellow color, the magenta color, and the cyan color; the corresponding color developing/quenching agents; and the photothermal conversion materials having absorption wavelengths different from one another, and the three layers are stacked. This makes it possible to provide a reversible recording medium enabling multicolor recording and having high color development stability as well as repeated drawability while maintaining color development sensitivity.

3. Modification Examples (3-1. Modification Example 1)

The foregoing second embodiment gives an example of providing a multilayer structure in which, as the recording layer 21, the layers (the first layer 22, the second layer 23, and the third layer 24) to be colored differently from one another are formed, and the layers are stacked. However, for example, even a single layer structure allows for achievement of a reversible recording medium that enables multicolor display FIG. 3 illustrates a recording layer 32 that is formed, for example, by mixing three types of microcapsules 32C, 32M, and 32Y including respective coloring compounds to be colored differently from one another (e.g., cyan color (C), magenta color (M), and yellow color (Y)), respective color developing/quenching agents corresponding to the coloring compounds, and respective photothermal conversion materials that absorb light in wavelength regions different from one another to generate heat. The recording layer 32 may be formed, for example, by dispersing the above-described microcapsules 32C, 32M, and 32Y in a macromolecular material exemplified as the constituent material of the above-described recording layer 12 and applying the resultant dispersion onto the support base 11. It is to be noted that, for example, the material that configures the above-described heat-insulating layers 25 and 26 is preferably used as the microcapsule that incorporates the above-described materials.

(3-2. Modification Example 2)

The foregoing first embodiment and second embodiment give examples in which the recording layer 12 and the recording layer 21 (the first layer 22, the second layer 23, and the third layer 24) are each formed using a single (one type) coloring compound; however, this is not limitative. In the reversible recording media 1 and 2 according to the respective foregoing first and second embodiments, the recording layers 12 and 21 (the first layer 22, the second layer 23, and the third layer 24) may be each formed using a mixture of a plurality of types of coloring compounds to be colored differently from one another.

It is difficult, in a reversible recording medium, to perform color reproduction of cyan, magenta, and yellow (CMY) according to Japan Color certification system, using a single coloring compound (a leuco pigment). Further, the photothermal conversion material has a slight color tone, and thus the type and the content of the photothermal conversion material cause a color tone of each of the recording layers 12 and 21 to be slightly changed. Developing a coloring compound for each and every slight change causes manufacturing efficiency to be significantly lowered.

In contrast, the present modification example involves forming a recording layer by mixing a plurality of types of coloring compounds, thus making it possible to reproduce various colors including CMY according to the Japan Color certification system. For example, the cyan color may be reproduced by mixing a coloring compound to be colored in a blue color and a coloring compound to be colored in a green color at a predetermined rate. The magenta color may be reproduced by mixing a coloring compound to be colored in a red color and a coloring compound to be colored in an orange color at a predetermined rate.

It is to be noted that, typically, when a plurality of types of coloring compounds are mixed to form a recording layer, a degree of decoloring with respect to temperature varies, as compared with the case of using a single coloring compound. One reason for this is that acidity (basicity) varies depending on coloring compounds. Specifically, a recording layer in a reversible recording medium is typically configured using a basic coloring compound and an acidic color developing/quenching agent; reaction thereof causes coloring, and dissociation thereof causes decoloring. In other words, when the basicity of the coloring compound and the acidity of the color developing/quenching agent are each high, color-developing performance becomes high, thus making it difficult to perform decoloring. Accordingly, in a case where the plurality of types of coloring compounds are mixed to form a recording layer, decoloring performance of the recording layer is determined by the coloring compounds. This causes issues in which decoloring is not possible at the same temperature upon decoloring and in which it becomes difficult to reproduce medium gradation.

In contrast, the reversible recording medium 1 or the like of the present disclosure involves using color developing/quenching agents each having a long alkyl chain (having 25 to 34 carbon atoms), which allows for higher intermolecular force between the color developing/quenching agents, making it easier for the color developing/quenching agents to be aligned in the recording layer 31, thus enhancing the decoloring performance. Accordingly, any of the reversible recording media 1 and 2 of the present disclosure allows for achievement of the decoloring performance equivalent to that of the case of using the single coloring compound for formation, even when using the plurality of types of coloring compounds to form the recording layers 12 and 21. It is to be noted that, also in a reversible recording medium 3 of the foregoing modification example, the microcapsules 32C, 32M, and 32Y that configure the recording layer 31 may be each formed using a plurality of types of coloring compounds.

4. Third Embodiment

FIG. 4 illustrates a cross-sectional configuration of a reversible recording medium (a reversible recording medium 4) according to a third embodiment of the present disclosure. The reversible recording medium 4 includes, for example, a recording layer 42 that is disposed on the support base 11 and allows for reversible change between a recorded state and a deleted state. The recording layer 42 is formed using, as a coloring compound, a compound represented by the following general formula (3).

(4-1. Configuration of Reversible Recording Medium)

The support base 11 and the protective layer 13 have configurations similar to those of the reversible recording medium 1 in the foregoing first embodiment.

The recording layer 42 enables information to be recorded and deleted reversibly by heat. The recording layer 42 is configured using a material that allows for stable repeated recording and allows for control of a decolored state and a color-developed state. Specifically, the recording layer 42 includes a coloring compound, a color developing/quenching agent, and a photothermal conversion material, and is formed, for example, by a macromolecular material. The recording layer 42 has a thickness in a range from 1 μm to 10 μm, for example.

Examples of the coloring compound include a compound having a phthalide skeleton represented by the following general formula (3) and containing a group having an electron-donating property.

(3)

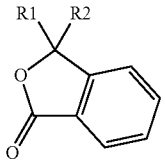

(R1 and R2, each independently, denote a phenyl group, an aminophenyl group, an indolyl group, a benzoindolyl group, a quinolone group, a naphthalene group, or an alkyl group, or a derivative thereof. Alternatively, R1 and R2 may be bonded to each other via carbon (C), nitrogen (N), oxygen (O), and sulfur (S) to form a condensed aliphatic ring or a condensed aromatic ring.)

Materials similar to those of the recording layer 12 in the foregoing first embodiment may be used as the color developing/quenching agent, the photothermal conversion material, and the macromolecular material.

The recording layer 42 includes at least one of the coloring compounds, at least one of the color developing/quenching agents, and at least one of the photothermal conversion materials. Similarly to the above-described recording layer 12, it is preferable for the coloring compound and the color developing/quenching agent included in the recording layer 42 to have a ratio between the coloring compound and the color developing/quenching agent being equal to 1:2 (weight ratio), for example. The photothermal conversion agent is changed depending on the thickness of the recording layer 42. Further, the recording layer 42 may include, in addition to the above-mentioned materials, various additives such as a sensitizer and an ultraviolet absorbing agent, for example.

Increasing the acidity of the color developing/quenching agent is considered to be an effective way in order to enhance the color-developing property of a recording medium. Accordingly, it is preferable to use the compound having the salicylic acid skeleton as the color developing/quenching agent. Further, in order to enhance color development stability and repeated drawability while maintaining color development sensitivity, it is preferable to use the compound having the salicylic acid skeleton that is represented by the above general formula (1) and contains, in a molecule, a group having an electron-donating property (e.g., an alkyl chain).

In a case where the above-described color developing/quenching agent is used, however, there is a possibility that light-resistant stability may be lowered depending on the structure of the coloring compound. For example, when using, as the coloring compound, a pigment having an azaphthalide skeleton that is typically mentioned as a pigment having high light resistance, the light-resistant stability may be lowered in some cases.

In contrast, the reversible recording medium 4 according to the present embodiment involves using, as the coloring compound having an electron-donating property, the compound that has the phthalide skeleton in a molecule and is represented by the above general formula (2). This achieves an effect of making it possible to enhance the light-resistant stability, in addition to the effects of the foregoing first embodiment.

5. Application Examples

Next, description is given of application examples of the reversible recording medium (e.g., the reversible recording medium 1, etc.) described in each of the foregoing first, second and third embodiments, and Modification Examples 1 and 2. However, a configuration of an electronic apparatus described below is merely exemplary, and the configuration may be varied appropriately. Any of the foregoing reversible recording media 1 to 3 is applicable to a portion of various electronic apparatuses or various clothing accessories, e.g., a portion of clothing accessories such as a watch (wristwatch), a bag, clothes, a hat, glasses, and shoes, as a so-called wearable terminal; the type of the electronic apparatuses, etc. is not particularly limited. In addition, it is also possible to apply, not only to the electronic apparatuses or the clothing accessories, but also to, as an exterior member, an interior or an exterior such as a wall, etc. of a building, an exterior of furniture such as a desk, and the like.

(Application Example 1)

FIGS. 5A and 5B each illustrate an appearance of an integrated circuit (IC) card with a rewritable function. The IC card has a card surface that serves as a printing surface 110, and includes, for example, a sheet-shaped reversible recording medium 1, etc. that is adhered thereto. The IC card allows for drawing on the printing surface 110 as well as rewriting and deletion thereof appropriately by disposing the reversible recording medium 1, etc. on the printing surface 110, as illustrated in FIGS. 5A and 5B.

(Application Example 2)

FIG. 6A illustrates a configuration of an appearance of a front surface of a smartphone, and FIG. 6B illustrates a configuration of an appearance of a rear surface of the smartphone illustrated in FIG. 6A. The smartphone includes, for example, a display part 210, a non-display part 220, and a casing 230. An entire surface, for example, of the casing 230 on side of the rear surface is provided with, for example, the reversible recording medium 1, etc. as the exterior member of the casing 230. This allows for display of various color patterns as illustrated in FIG. 6B. It is to be noted that, although the smartphone is exemplified here, this is not limitative; it is also possible to apply, for example, to a notebook personal computer (PC), a tablet PC, or the like.

(Application Example 3)

FIGS. 7A and 7B each illustrate an appearance of a bag. The bag includes a storing part 310 and a handle 320, for example, and the reversible recording medium 1, for example, is attached to the storing part 310. Various letters and patterns are displayed on the storing part 310 by means of the reversible recording medium 1, for example. The attachment of the reversible recording medium 1, etc. to a part of the handle 320 allows for display of various color patterns, and allows for change in design of the storing part 310, as illustrated, from the example of FIG. 7A to the example of FIG. 7B. It is also possible, for the purpose of fashion, to achieve a useful electronic device.

(Application Example 4)

FIG. 8 illustrates a configuration example of a wristband able to record, in an amusement park, attraction-riding history, schedule information, and the like, for example. The wristband includes belt parts 411 and 412 and an information recording part 420. The belt parts 411 and 412 have a band shape, for example, and respective ends (unillustrated) thereof are configured to be connectable to each other. The reversible recording medium 1, etc., for example, is adhered to the information recording part 420, and attraction-riding history MH2 and schedule information IS (IS1 to IS3) as described above and an information code CD, for example, are recorded. In the amusement park, a visitor is able to record the above-described information by waving the wristband over a drawing apparatus installed at every location of attraction-riding reservation spots.

A riding history mark MH1 indicates the number of attractions ridden by a visitor who wears the wristband in the amusement park. In this example, as the visitor rides the more attractions, the more star-shaped marks are recorded as the riding history mark MH1. It is to be noted that this is not limitative; for example, the color of the mark may be changed in accordance with the number of attractions ridden by the visitor.

The schedule information IS in this example indicates a schedule of the visitor. In this example, information about all of events including an event reserved by the visitor and an event to be held in the amusement park is recorded as the schedule information IS1 to IS3. Specifically, in this example, a title of an attraction (an attraction 201) of which riding reserved by the visitor and scheduled time of the riding are recorded as the schedule information IS1. Further, an event such as a parade in the park and its scheduled starting time are recorded as the schedule information IS2. Furthermore, a restaurant reserved beforehand by a visitor 5 and its scheduled mealtime are recorded as the schedule information IS3.

The information code CD records, for example, identification information IID that is used to identify the wristband and website information IWS.

6. Working Examples

Next, description is given in detail of working examples of the present disclosure. It is to be noted that reversible recording media produced in experiments as described below were evaluated using the following as a reference.

As described above, the reversible recording medium is conceived to be applied to, in addition to printing on an IC card, a label, or the like, for example, decoration of a surface of a casing of an electronic apparatus, etc. or an interior, an exterior, or the like of a building. Accordingly, the reversible recording medium is desired to have weather resistance that enables withstanding a weathering test assuming that the reversible recording medium would be left outdoors, e.g., under the most stringent condition.

The International Standard and JIS standard specifies that an accelerated exposure test be carried out as a method for evaluating the weather resistance. The accelerated exposure test includes two tests: a test (accelerated weathering test) that evaluates changes in color, gloss, strength, and the like of an organic material such as coating, plastic, and rubber; and a test (accelerated corrosion test) that evaluates corrosion resistance of an inorganic material such as metal basis and plating. Among those tests, the accelerated weathering test is applicable to the evaluation of the weather resistance of the reversible recording medium of the present disclosure.

The accelerated weathering test is a test that incorporates temperature, humidity, and wetness into a test condition, using an artificial light source simulating a spectral distribution of sunlight. Examples of the artificial light source to be used include a xenon arc lamp, an open-flame carbon arc lamp, an ultraviolet carbon arc lamp, an ultraviolet fluorescent lamp, and a metal halide lamp. An artificial light source to be used is often determined by material qualities of samples (test pieces) and usage environments. A temperature of a black panel, that is placed together with the sample for calibration, of 63±3° C. is often adopted as a reference for a temperature inside a test vessel; the reference is not influenced by the light source.

Test time is largely influenced by respective usage environments and usage methods, and thus is difficult to be defined. As a reference, Japan Weathering Test Center discloses, in its website, lists of test time for various product standards that specify, as the most stringent condition, test time of 1,000 hours for a plastic board, a safety sign board, and the like.

It is considered, in the accelerated weathering test, that, because of the temperature of the black panel being 63±3° C., there is a low possibility that a temperature of the reversible recording medium during the test may reach or exceed this temperature. Accordingly, a reference value of a color development stability test of the reversible recording medium according to the present disclosure is set to 1,000 hours at 63±3° C. The color-developing property is able to be determined in accordance with color density, and results in being visually recognized by human eyes when the density falls to or below 80% of the density from a maximumly color-developed state. Thus, it is made a condition that the color development density of 80% or more is maintained when a heat-sensitive recording layer in a color-developed state is stored at 63±3° C. or lower for 1,000 hours.

(Experiment 1: Evaluation of Storage Stability and Repeated Drawability)

(Experimental Example 1-1)

First, a color developing/quenching agent was synthesized. 10 g of nonacosane acid ($C_{28}H_{57}COOH$), 4.6 g of triethylamine, and 50 ml of toluene were placed into a flask, and were heated to 40° C. Subsequently, 6.3 g of DPPA was added followed by refluxing, and thereafter the resultant was left to cool to room temperature. Next, a solvent was removed to give 16.2 g of octacosyl isocyanate. Subsequently, the 16.2 g of octacosyl isocyanate having been dissolved in tetrahydrofuran (THF) was added to 4.2 g of 4-aminosalicylic acid having been placed into another flask to perform heating under refluxing. The resultant was cooled to room temperature, and a precipitated solid was filtrated and washed. This gave a color developing/quenching agent K-01 represented by the following formula (1-1).

(1-1)

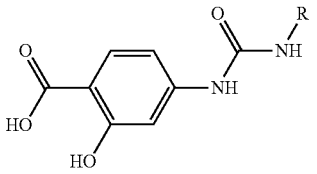

Next, a reversible recording medium coating was prepared to form a recording layer as a film. A vinyl chloride/vinyl acetate copolymer was dissolved in methyl ethyl ketone (MEK), followed by further addition of the color developing/quenching agent K-01, and the resultant was dispersed using a rocking mill. A leuco pigment represented by the above formula (2-1) was added thereto, and the preparation was made to have a final ratio of the leuco pigment, the color developing/quenching agent, and the vinyl chloride/vinyl acetate copolymer (average molecular weight of 115,000) being equal to 1:2:4. Further, a photothermal conversion material Y-01 having a phthalocyanine skeleton was added to prepare the reversible recording medium coating. Subsequently, the reversible recording medium coating was applied as a film onto the PET having a thickness of 50 μm using a wire bar to have a thickness of 3 μm, and the resultant film was dried at 70° C. for 30 minutes to give the recording layer (Experimental Example 1-1). At this occasion, the preparation was made to allow a density of the photothermal conversion material Y-01 included in the recording layer to have an absorbance value of 1 at a wavelength of 920 nm.

(Experimental Example 1-2)

In Experimental Example 1-2, a recording layer was produced using a method similar to that of Experimental Example 1-1 described above except that the nonacosane acid ($C_{28}H_{57}COOH$) was replaced by $C_{29}H_{59}COOH$ to synthesize a color developing/quenching agent (a color developing/quenching agent K-02) for being used.

(Experimental Example 1-3)

In Experimental Example 1-3, a recording layer was produced using a method similar to that of Experimental Example 1-1 described above except that the nonacosane acid ($C_{28}H_{57}COOH$) was replaced by $C_{26}H_{53}COOH$ to synthesize a color developing/quenching agent (a color developing/quenching agent K-03) for being used.

(Experimental Example 1-4)

In Experimental Example 1-4, a recording layer was produced using a method similar to that of Experimental Example 1-1 described above except that the nonacosane acid ($C_{28}H_{57}COOH$) was replaced by $C_{25}H_{51}COOH$ to synthesize a color developing/quenching agent (a color developing/quenching agent K-04) for being used.

(Experimental Example 1-5)

In Experimental Example 1-5, a recording layer was produced using a method similar to that of Experimental Example 1-1 described above except that the nonacosane acid ($C_{28}H_{57}COOH$) was replaced by $C_{24}H_{49}COOH$ to synthesize a color developing/quenching agent (a color developing/quenching agent K-05) for being used.

(Experimental Example 1-6)

In Experimental Example 1-6, a recording layer was produced using a method similar to that of Experimental Example 1-1 described above except that the nonacosane acid ($C_{28}H_{57}COOH$) was replaced by $C_{23}H_{47}COOH$ to synthesize a color developing/quenching agent (a color developing/quenching agent K-06) for being used.

(Experimental Example 1-7)

In Experimental Example 1-7, a recording layer was produced using a method similar to that of Experimental Example 1-1 described above except that the nonacosane acid ($C_{28}H_{57}COOH$) was replaced by $C_{22}H_{45}COOH$ to synthesize a color developing/quenching agent (a color developing/quenching agent K-07) for being used.

(Experimental Example 1-8)

In Experimental Example 1-8, a recording layer was produced using a method similar to that of Experimental Example 1-1 described above except that the nonacosane acid ($C_{28}H_{57}COOH$) was replaced by $C_{21}H_{43}COOH$ to synthesize a color developing/quenching agent (a color developing/quenching agent K-08) for being used.

(Experimental Example 1-9)

In Experimental Example 1-9, a recording layer was produced using a method similar to that of Experimental Example 1-1 described above except that the nonacosane acid ($C_{28}H_{57}COOH$) was replaced by $C_{18}H_{37}COOH$ to synthesize a color developing/quenching agent (a color developing/quenching agent K-09) for being used.

(Experimental Example 1-10)

In Experimental Example 1-10, a recording layer was produced using a method similar to that of Experimental Example 1-1 described above except that the nonacosane acid ($C_{28}H_{57}COOH$) was replaced by $C_{14}H_{29}COOH$ to synthesize a color developing/quenching agent (a color developing/quenching agent K-10) for being used.

(Experimental Example 1-11)

In Experimental Example 1-11, a recording layer was produced using a method similar to that of Experimental Example 1-1 described above except that the photothermal conversion material having the phthalocyanine skeleton was replaced by a photothermal conversion material (Y-02) having a squarylium skeleton.

(Experimental Example 1-12)

In Experimental Example 1-12, a recording layer was produced using a method similar to that of Experimental Example 1-1 described above except that the photothermal conversion material having the phthalocyanine skeleton was replaced by a photothermal conversion material (Y-03) including a metal oxide.

(Experimental Example 1-13)

In Experimental Example 1-13, a recording layer was produced using a method similar to that of Experimental Example 1-1 described above except that the photothermal conversion material having the phthalocyanine skeleton was replaced by a photothermal conversion material (Y-04) having a cyanine skeleton using iodine (I) as a counter ion.

(Experimental Example 1-14)

In Experimental Example 1-14, a recording layer was produced using a method similar to that of Experimental Example 1-1 described above except that the photothermal conversion material having the phthalocyanine skeleton was replaced by a photothermal conversion material (Y-05) having a cyanine skeleton using SbF6 as a counter ion and containing a ring structure in a methine chain.

Results of Experimental Examples 1-1 to 1-14 described above were listed in Table 1, with evaluation of a color-developing property, a decoloring property, storage stability at 63° C., and repeated drawability. As for the color-developing property, a heat-sensitive printer was used to heat the produced reversible recording medium (sample), thereby causing the entire recording layer to develop a color, and a spectrophotometer available from X-rite Inc. was used to measure color density of the recording layer. In these examples, a color density of 1.0 or higher was ranked A, and a color density of lower than 1.0 was ranked B. As for the decoloring property, the sample having been caused to develop a color for the above-described evaluation of the color-developing property was heated at 120° C. for one second using a heat gradient tester available from Toyo Seiki Seisaku-Sho, and the spectrophotometer available from X-rite Inc. was used to measure the color density. In these examples, a color density of 0.2 or lower was ranked A, and a color density of higher than 0.2 was ranked B.

As for the storage stability, the sample having been caused to develop a color for the above-described evaluation of the color-developing property was stored in a thermostat bath at 63° C., and time until attenuation of the color density to 80% was measured. It is to be noted that, due to longer period of time for a sample having a long alkyl chain, measurement was carried out in such a state that a temperature of the thermostat bath was raised to 70° C. or 80° C., and storing time until reaching 63° C. was calculated from Arrhenius plot. In these examples, a case where time required for the color density of the recording layer to be attenuated to 80% was 1,000 hours or more was ranked A, a case where the time was in a range from 25 hours to 1,000 hours was ranked B, and a case where the time was less than 25 hours was ranked C.

As for the repeated drawability, five-time repetition was performed for a color-developing process and a decoloring process that use a laser of a near infrared wavelength corresponding to the photothermal conversion material used in each of Experimental Examples 1-1 to 1-14, and measurement was made of a change in the color development density. Table 1 lists configurations of respective Experimental Examples 1-1 to 1-14 and results thereof In these examples, a case where the color development density at the fifth time was kept at 80% or higher was ranked A, and a case of being lower than 80% was ranked B.

TABLE 1

| Experimental Example | Color Developing/ Quenching Agent | Alkyl Chain Length of R-part | Photo-thermal Conversion Agent | Color-Developing Property | Decoloring Property | Storage Stability: Time until Attenuation of Color Development Density to 80% (h) | Storage Stability: Judgment | Repeated Drawability |
|---|---|---|---|---|---|---|---|---|
| 1-1 | K-01 | 28 | Y-01 | A | A | $5 \times 10^5$ | A | A |
| 1-2 | K-02 | 29 | Y-01 | A | A | $4 \times 10^6$ | A | A |
| 1-3 | K-03 | 26 | Y-01 | A | A | $1 \times 10^4$ | A | A |
| 1-4 | K-04 | 25 | Y-01 | A | A | 1500 | A | A |
| 1-5 | K-05 | 24 | Y-01 | A | A | 220 | B | A |
| 1-6 | K-06 | 23 | Y-01 | A | A | 31 | B | A |
| 1-7 | K-07 | 22 | Y-01 | A | A | 4 | C | A |
| 1-8 | K-08 | 21 | Y-01 | A | C | 1 | C | A |
| 1-9 | K-09 | 18 | Y-01 | A | C | 0.7 | C | A |
| 1-10 | K-10 | 14 | Y-01 | A | C | 0.7 | C | A |
| 1-11 | K-01 | 28 | Y-02 | A | A | $5 \times 10^5$ | A | A |
| 1-12 | K-01 | 28 | Y-03 | A | A | $5 \times 10^5$ | A | A |
| 1-13 | K-01 | 28 | Y-04 | A | A | $5 \times 10^5$ | A | B |
| 1-14 | K-01 | 28 | Y-05 | A | A | $5 \times 10^5$ | A | A |

It was appreciated, from results of Experimental Examples 1-5 to 1-10, that the storage stability (color development stability) was lowered when the alkyl chain length was short (with 14 to 24 carbon atoms). Further, in Experimental Examples 1-8 to 1-10, in which the alkyl chain length was shorter, among Experimental Examples 1-5 to 1-10, the decoloring property was also low. It was appreciated from this result that low color development stability does not necessarily lead to superior decoloring property.

As for the repeated drawability, it was appreciated, from results of Experimental Examples 1-1, 1-11, and 1-12, that use of a photothermal conversion material having a phthalocyanine skeleton or a squarylium skeleton and a photothermal conversion material including an inorganic compound allowed for achievement of superior repeated drawability. Further, in Experimental Example 1-13 using a photothermal conversion material having a cyanine skeleton, the photothermal conversion material was deteriorated, making it unable to maintain the repeated drawability. However, in Experimental Example 1-14 using a photothermal conversion material (Y-05) having a cyanine skeleton using SbF6 as a counter ion and containing a ring structure in a methine chain, superior repeated drawability was achieved. It was appreciated from this result that, when having superior light resistance and heat resistance, even the photothermal conversion material having a cyanine skeleton was able to achieve the superior repeated drawability.

It is to be noted that, although Experimental Example 1 exemplifies the results in which the storage stability and the repeated drawability were evaluated using only the coloring compound (leuco pigment) to be colored in a blue color represented by the formula (2-1), similar results were also obtained in cases of using leuco pigments represented by the following formulae (2-2) to (2-5), for example.

(2-2)

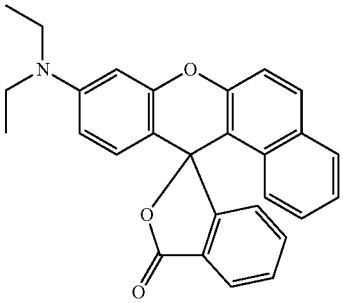

(2-3)

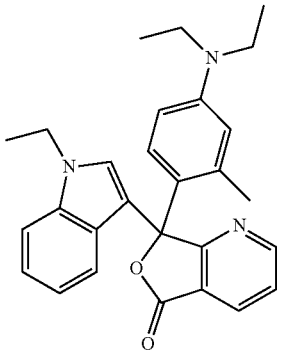

-continued (2-4)

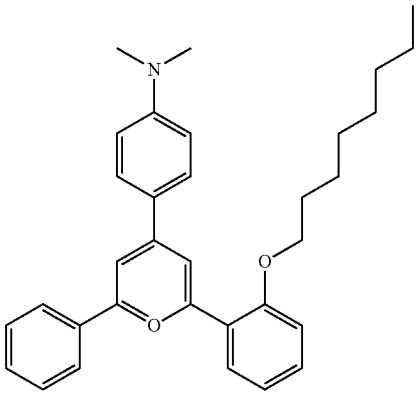

(2-5)

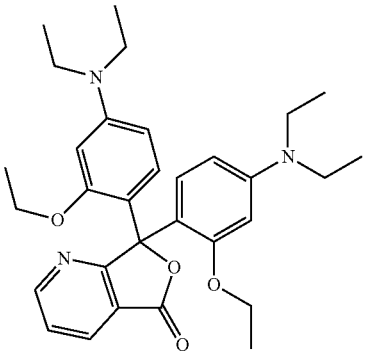

(Experiment 2: Evaluation of Color-Developing Property and Decoloring Property using Color-Developing/Quenching Agent)

(Experimental Example 2-1)

A recording layer was produced, on the support base, using the same material and the same film-forming method as those of Experimental Example 1 as described above except using the leuco pigment represented by the above formula (2-1) as the coloring compound and the color developing/quenching agent K-01 as the color developing/quenching agent.

(Experimental Example 2-2)

A recording layer was produced using a method similar to that of Experimental Example 2-1 except using the leuco pigment represented by the above formula (2-2) as the coloring compound.

(Experimental Example 2-3)

A recording layer was produced using a method similar to that of Experimental Example 2-1 except using the leuco pigment represented by the above formula (2-4) as the coloring compound.

(Experimental Example 2-4)

A recording layer was produced using a method similar to that of Experimental Example 2-1 except using the color developing/quenching agent K-09.

(Experimental Example 2-5)

A recording layer was produced using a method similar to that of Experimental Example 2-2 except using the color developing/quenching agent K-09.

(Experimental Example 2-6)

A recording layer was produced using a method similar to that of Experimental Example 2-3 except using the color developing/quenching agent K-09.

As for the above-described Experimental Examples 2-1 to 2-6, a heat gradient tester available from Toyo Seiki Seisaku-Sho was used to apply temperature for a predetermined period of time for color development of a recording layer, and thereafter a relationship between color development density and temperature was observed. FIG. 9 illustrates changes plotted in the color development density (O.D. value) with respect to temperature changes in Experimental Examples 2-1 to 2-3. FIG. 10 illustrates changes plotted in the color development density (O.D. value) with respect to temperature changes in Experimental Examples 2-4 to 2-6. Table 2 lists a temperature (T1) at which the color development density becomes 0.8 and a temperature (T2) at which the color development density becomes 0.2 in a case where initial color development density of each of Experimental Examples 2-1 to 2-6 is set to 1.

| Experimental Example | Color Developing Agent | Leuco Pigment | T1 (° C.) | T2 (° C.) |
|---|---|---|---|---|
| 2-1 | K-01 | (2-1) | 92 | 95 |
| 2-2 | | (2-2) | 90 | 95 |
| 2-3 | | (2-4) | 92 | 100 |
| 2-4 | K-09 | (2-1) | 107 | 125 |
| 2-5 | | (2-2) | 105 | 125 |
| 2-6 | | (2-4) | 88 | 120 |

In Experimental Examples 2-4 to 2-6 each using the color developing/quenching agent K-09, a difference in T1 was 19° C. In contrast, in Experimental Examples 2-1 to 2-3 each using the color developing/quenching agent K-01, a difference in T1 was 2° C. As for T2, a difference therein was 5° C. both in Experimental Examples 2-4 to 2-6 each using the color developing/quenching agent K-09 and in Experimental Examples 2-1 to 2-3 each using the color developing/quenching agent K-01.

This indicates that gradient dispersion of a decoloration curve is larger in Experimental Examples 2-4 to 2-6 each using the color developing/quenching agent K-09 than that in Experimental Examples 2-1 to 2-3 each using the color developing/quenching agent K-01, as appreciated from the decoloration curve that represents changes in the color development density (O.D. value) with respect to the temperature changes in the respective experimental examples illustrated in FIGS. 9 and 10. In a case where there is gradient dispersion in a decoloration curve, it is difficult to perform temperature control for gradation expression. Further, as a temperature range from starting of decoloring to decoloration becomes narrower, tone of the recording layer becomes easier to be controlled. It was appreciated from the above that it was preferable to use a color developing/quenching agent having a steep temperature gradient at the time of deletion and having a long alkyl chain of R-part (e.g., a color developing/quenching agent K-01 having 28 carbon atoms), as the color developing/quenching agent to be used for the reversible recording medium.

Further, it was appreciated, in Experimental Examples 2-1 to 2-3 each using the color developing/quenching agent K-01, that, because of a small difference of 2° C. in T1, the use of such a color developing/quenching agent as the color developing/quenching agent K-01 having a long alkyl chain of R-part made deletability less influenced by a leuco pigment. That is, it was appreciated that the color developing/quenching agent having a long alkyl chain of R-part was highly effective in a case where the type of leuco pigments constituting a recording layer was changed or where a plurality of types of leuco pigments were mixed at an arbitrary ratio and used.

FIG. 11 illustrates deletion curves of a recording layer in which K-01 is used as the color developing/quenching agent and two types of leuco pigments represented by the formulae (2-1) and (2-4) are used as coloring compounds and mixed at an arbitrary ratio. Mixture ratios between the two types of leuco pigments (formula (2-1)/formula (2-4)) are 9/1, 8/2, 7/3, and 6/4 in weight ratio. It was appreciated from FIG. 11 that the use of K-01 that is an example of the color developing/quenching agent of the present disclosure allowed for a substantially constant deletion curve regardless of the mixture ratio of the leuco pigments. In other words, by configuring a recording layer using a plurality of types of coloring compounds and the color developing/quenching agent of the present disclosure, it becomes possible to provide a reversible recording medium with high color reproducibility having high color development stability and high repeated drawability while maintaining color development sensitivity.

(Experiment 3: Evaluation of Light-Resistant Stability)

(Experimental Example 3-1)

First, a color developing/quenching agent was synthesized. 10 g of octacosanoic acid ($C_{27}H_{55}COOH$), 4.6 g of triethylamine, and 50 ml of toluene were placed into a flask, and were heated to 40° C. Subsequently, 6.3 g of DPPA was added followed by refluxing, and thereafter the resultant was left to cool to room temperature. Next, a solvent was removed to give 16.2 g of octacosyl isocyanate. Subsequently, the 16.2 g of octacosyl isocyanate having been dissolved in tetrahydrofuran (THF) was added to 4.2 g of 4-aminosalicylic acid having been placed into another flask to perform heating under refluxing. The resultant was cooled to room temperature, and a precipitated solid was filtrated and washed. This gave a color developing/quenching agent K-01 of which R in the above formula (1-1) was $C_{27}H_{55}$.

Next, a reversible recording medium coating was prepared to form a recording layer as a film. A vinyl chloride/vinyl acetate copolymer was dissolved in methyl ethyl ketone (MEK), followed by further addition of a color developing/quenching agent K-11, and the resultant was dispersed using a rocking mill. A leuco pigment represented by the following formula (3-1) was added thereto, and the preparation was made to have a final ratio of the leuco pigment, the color developing/quenching agent, and the vinyl chloride/vinyl acetate copolymer (average molecular weight of 115,000) being equal to 1:2:4. Further, the photothermal conversion material Y-01 having the phthalocyanine skeleton was added to prepare the reversible recording medium coating. Subsequently, the reversible recording medium coating was applied as a film onto the PET having a thickness of 50 μm using a wire bar to have a thickness of 3 μm, and the resultant film was dried at 70° C. for 30 minutes to give the recording layer (Experimental Example 1-1). At this occasion, the preparation was made to allow a density of the photothermal conversion material Y-01 included in the recording layer to have an absorbance value of 1 at a wavelength of 920 nm.

(Experimental Example 3-2)

In Experimental Example 3-2, a recording layer was produced using a method similar to that of Experimental Example 3-1 described above except that the leuco pigment represented by the formula (3-1) was replaced by a leuco pigment represented by the following formula (4-1).

(Experimental Example 3-3)

In Experimental Example 3-3, a recording layer was produced using a method similar to that of Experimental Example 3-1 described above except that the leuco pigment represented by the formula (3-1) was replaced by a leuco pigment represented by the following formula (3-2).

(Experimental Example 3-4)

In Experimental Example 3-4, a recording layer was produced using a method similar to that of Experimental Example 3-1 described above except that the leuco pigment represented by the formula (3-1) was replaced by a leuco pigment represented by the following formula (4-2).

(Experimental Example 3-5)

In Experimental Example 3-5, a recording layer was produced using a method similar to that of Experimental Example 3-1 described above except that the leuco pigment represented by the formula (3-1) was replaced by a leuco pigment represented by the following formula (3-3).

(Experimental Example 3-6)

In Experimental Example 3-6, a recording layer was produced using a method similar to that of Experimental Example 3-1 described above except that the leuco pigment represented by the formula (3-1) was replaced by the leuco pigment represented by the above formula (2-5).

(Experimental Example 3-7)

In Experimental Example 3-7, 4-aminomethoxyphenol was used instead of 4-aminosalicylic acid to perform a reaction similar to that in Experimental Example 3-1, and thereafter a methoxy group was eliminated to synthesize a color developing/quenching agent represented by the following formula (1-2). Thereafter, a recording layer was produced using a method similar to that of Experimental Example 3-1 described above.

(Experimental Example 3-8)

In Experimental Example 3-8, a recording layer was produced using a method similar to that of Experimental Example 3-7 described above except that the leuco pigment represented by the formula (3-1) was replaced by the leuco pigment represented by the following formula (3-2).

(3-1)

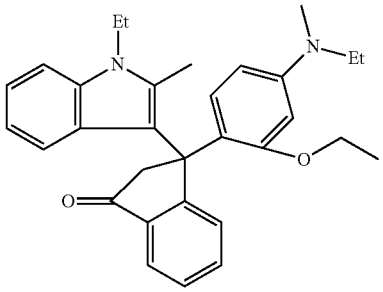

(3-2)

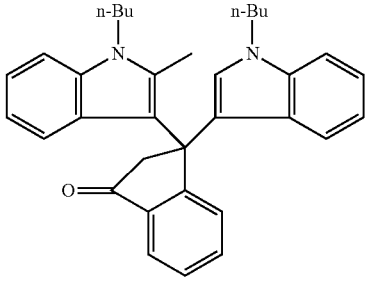

-continued (3-3)

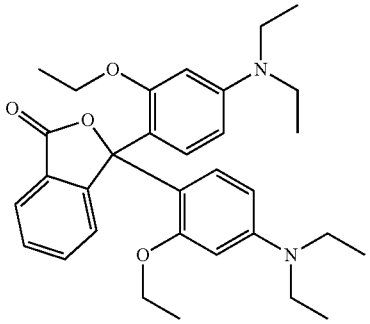

(4-1)

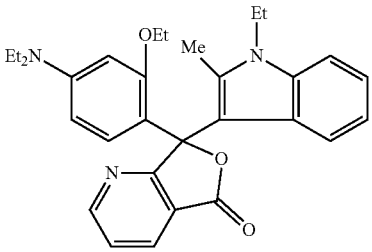

(4-2)

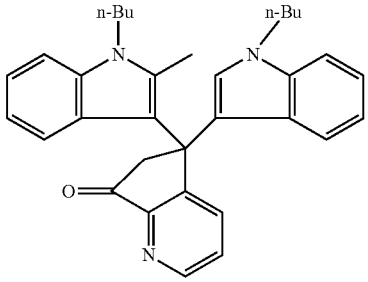

(1-2)

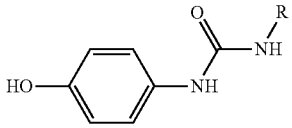

R: $C_{27}H_{55}$-

As for Experimental Examples 3-1 to 3-8 as described above, the color-developing property, the decoloring property, the storage stability at 63° C., the repeated drawability, and the light-resistant stability were evaluated, and results thereof are listed in Table 3. As for the color-developing property, the decoloring property, and the repeated drawability, an evaluation method and an evaluation standard similar to those of Experiment 1 described above were adopted. As for the storage stability, an evaluation method similar to that of Experiment 1 was adopted, in which a case where time required to attenuate the color density of a recording layer to 80% was 1,000 hours or more was ranked A, and a case of being less than 1,000 hours was ranked B.

As for the light-resistant stability, a UV barrier film was provided on a sample having been caused to develop a color for the evaluation of the color-developing property, and irradiation was performed with a xenon lamp having an illumination of 60 W using a light-resistance tester available from Q-Lab Corporation to measure time for attenuation of the color density to 80%. A case where the time exceeded 200 hours was ranked A, and a case of the time being less than 200 hours was ranked B.

TABLE 3

| Experimental Example | Color Developing/ Quenching Agent | Leuco Pigment | Color-Developing Property | Decoloring Property | Storage Stability | Repeated Drawability | Light-Resistant Stability |
|---|---|---|---|---|---|---|---|
| 3-1 | K-11 | Formula (3-1) | A | A | A | A | A |
| 3-2 | K-11 | Formula (4-1) | A | A | A | A | B |
| 3-3 | K-11 | Formula (3-2) | A | A | A | A | A |
| 3-4 | K-11 | Formula (4-2) | A | A | A | A | B |
| 3-5 | K-11 | Formula (3-3) | A | A | A | A | A |
| 3-6 | K-11 | Formula (2-5) | A | A | A | A | B |
| 3-7 | K-12 | Formula (3-1) | B | A | — | — | — |
| 3-8 | K-12 | Formula (4-1) | B | A | — | — | — |

When comparing Experimental Examples 3-1 and 3-2 with Experimental Examples 3-7 and 3-8, the color-developing property was significantly lowered in Experimental Examples 3-7 and 3-8. This is caused by difference in acidity of the color-developing/quenching agents; the color-developing/quenching agent having a salicylic acid skeleton has higher acidity than that having a phenol skeleton. It was appreciated from this result that it was preferable to use, as the color-developing/quenching agent, a compound having the salicylic acid skeleton having higher acidity.

When comparing Experimental Examples 3-1 to 3-6 with one another, Experimental Examples 3-1, 3-3, and 3-5 that use leuco pigments having phthalide skeletons represented, respectively, by the formulae (3-1), (3-2), and (3-3), light resistance was confirmed, which was superior to that in each of Experimental Examples 3-2, 3-4, and 3-6 that use leuco pigments having azaphthalide skeletons represented, respectively, by the formulae (4-1), (4-2), and (2-5). It was appreciated from this result that, in a case of using a salicylic acid-based color-developing/quenching agent, the use of the leuco pigment having the phthalide skeleton rather than the leuco pigment having the azaphthalide skeleton allowed for achievement of high light-resistant stability, with other structural parts of the leuco pigment having no large influence on the light-resistant stability. One conceivable reason for this lies in presence or absence of an active site in a molecule of the leuco pigment. The lueco pigment having the azaphthalide skeleton has a nitrogen (N) atom in the skeleton. An empty electron orbit is present in the N atom part, and there is a possibility that the part may be a reactive site (active site) with a color developing/quenching agent. In contrast, the leuco pigment having the phthalide skeleton has no N atom in the skeleton, and thus there is a low possibility that a part other than a lactone ring that is a color developing/decoloring site may be a reactive site with a color developing/quenching agent. Aside from those described above, there is a possibility that a material other than the color developing/quenching agent may absorb light to thereby attack a macromolecular material or other elements because of high acidity of the color developing/quenching agent, thus producing a radical in an active state. This results in causing direct or indirect damage to the leuco pigment. Accordingly, it is possible to state that, in a case of using a color developing/quenching agent having high acidity, it is preferable to use a leuco pigment having less active site, i.e., the coloring compound represented by the above formula (3).

Although the present disclosure has been described above with reference to the first and second embodiments, Modification Examples 1 and 2, and the working examples, the present disclosure is not limited to aspects described in the foregoing embodiments, etc., and may be modified in a variety of ways. For example, not all the components described in the foregoing first and second embodiments may necessarily be provided, and any other component may be further included. Moreover, the materials and the thicknesses of the above-described components are merely examples, and are not limited to those described herein.

It is to be noted that the effects described in the present specification are merely exemplary and not limitative, and may have other effects.

It is to be noted that the present disclosure may have the following configurations.

[1]

A reversible recording medium including:

a support base; and a recording layer provided on the support base and reversibly changing between a recorded state and a deleted state, the recording layer including a photothermal conversion material including one or more of a compound having a phthalocyanine skeleton, a compound having a squarylium skeleton, a compound having a cyanine skeleton that includes one of $SbF_6$, $PF_6$, $BF_4$, $ClO_4$, $CF_3SO_3$ and $(CF_3SO_3)_2N$ as a counter ion or a ring structure of a five-membered ring or a six-membered ring in a methine chain, and an inorganic compound, a coloring compound having an electron-donating property, and a color developing/quenching agent having an electron-accepting property and including at least one compound represented by the following general formula (1):

(1)

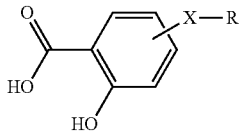

where X is one of —NHCO—, —CONH—, —NHCONH—, —CONHCO—, —NHNHCO—, —CONHNH—, —CONHNHCO—, —NHCO-CONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 25 to 34 carbon atoms.

[2]

The reversible recording medium according to [1], in which the recording layer includes two or more of the coloring compounds.

[3]

The reversible recording medium according to [1] or [2], in which the recording layer includes a plurality of layers.

[4]

The reversible recording medium according to any one of [1] to [3], in which the recording layer includes, as the plurality of layers, a first layer and a second layer, and the first layer and the second layer include the respective photothermal conversion materials having different absorption wavelength regions.

[5]

The reversible recording medium according to any one of [1] to [4], in which the photothermal conversion material has an absorption peak wavelength in a range from 700 nm to 2,000 nm.

[6]

The reversible recording medium according to any one of [1] to [5], in which the recording layer further includes a thermosetting resin or a thermoplastic resin.

[7]

The reversible recording medium according to any one of [1] to [6], in which the compound having the cyanine skeleton includes, in the molecule, one of $SbF_6$, $PF_6$, $BF_4$, $ClO_4$, $CF_3SO_3$ and $(CF_3SO_3)_2N$ as the counter ion and a ring structure of the five-membered ring or the six-membered ring in the methine chain.

[8]

The reversible recording medium according to any one of [1] to [7], in which irradiation is performed with a near infrared ray in a predetermined wavelength region to perform recording into the recording layer and deletion of the recording.

[9]

The reversible recording medium according to any one of [1] to [8], in which irradiation is performed with a semiconductor laser to perform recording into the recording layer and deletion of the recording.

[10]

A reversible recording medium including:

a support base; and a recording layer provided on the support base and reversibly changing between a recorded state and a deleted state, the recording layer including a photothermal conversion material including one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound, a coloring compound having an electron-donating property and being represented by the following general formula (2):

(2-1)

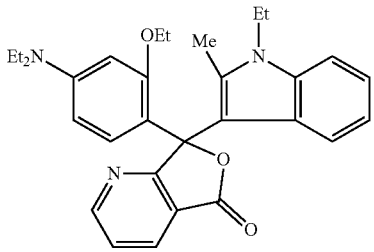

where R1 and R2, each independently, denote a phenyl group, an aminophenyl group, an indolyl group, a benzoindolyl group, a quinoline group, a naphthalene group, or an alkyl group, or a derivative thereof, or alternatively may be bonded to each other via carbon (C), nitrogen (N), oxygen (O), and sulfur (S) to form a condensed aliphatic ring or a condensed aromatic ring, and a color developing/quenching agent having an electron-accepting property.

[11]

A reversible recording medium coating including, in a solvent:

a photothermal conversion material including one or more of a compound having a phthalocyanine skeleton, a compound having a squarylium skeleton, a compound having a cyanine skeleton that includes one of $SbF_6$, $PF_6$, $BF_4$, $ClO_4$, $CF_3SO_3$ and $(CF_3SO_3)_2N$ as a counter ion or a ring structure of a five-membered ring or a six-membered ring in a methine chain, and an inorganic compound, a coloring compound having an electron-donating property, a coloring compound having an electron-donating property, and a color developing/quenching agent having an electron-accepting property and including at least one compound represented by the following general formula (1):

(1)

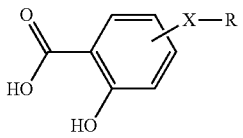

where X is one of —NHCO—, —CONH—, —NHCONH—, —CONHCO—, —NHNHCO—, —CONHNH—, —CONHNHCO—, —NHCO- CONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 25 to 34 carbon atoms.

[12]

An exterior member having at least one surface provided with a reversible recording medium, the reversible recording medium including:

a support base; and a recording layer provided on the support base and reversibly changing between a recorded state and a deleted state, the recording layer including a photothermal conversion material including one or more of a compound having a phthalocyanine skeleton, a compound having a squarylium skeleton, a compound having a cyanine skeleton that includes one of $SbF_6$, $PF_6$, $BF_4$, $ClO_4$, $CF_3SO_3$ and $(CF_3SO_3)_2N$ as a counter ion or a ring structure of a five-membered ring or a six-membered ring in a methine chain, and an inorganic compound, a coloring compound having an electron-donating property, a coloring compound having an electron-donating property, and a color developing/quenching agent having an electron-accepting property and including at least one compound represented by the following general formula (1):

(1-1)

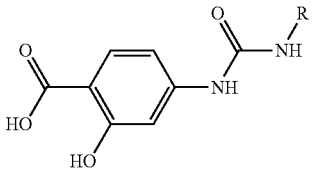

where X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 25 to 34 carbon atoms.

It should be understood by those skilled in the art that various modifications, combinations, sub-combinations, and alterations may occur depending on design requirements and other factors insofar as they are within the scope of the appended claims or the equivalents thereof.

The invention claimed is:

1. A reversible recording medium comprising:

a support base; and a recording layer provided on the support base and reversibly changing between a recorded state and a deleted state, the recording layer including a photothermal conversion material including one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound, and a mixture of three types of microcapsules including respective coloring compounds to be colored differently from one another and respective color developing/quenching agents corresponding to the respective coloring compounds, wherein the respective coloring compounds each comprise a coloring compound having an electron-donating property, and wherein the respective color developing/quenching agents each comprise a color developing/quenching agent having an electron-accepting property and including at least one compound represented by a following general formula (1):

(1)

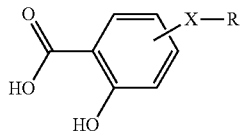

where X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 29 to 34 carbon atoms.

2. The reversible recording medium according to claim 1, wherein the photothermal conversion material has an absorption peak wavelength in a range from 700 nm to 2,000 nm.

3. The reversible recording medium according to claim 1, wherein the recording layer further includes a thermosetting resin or a thermoplastic resin.

4. The reversible recording medium according to claim 1, wherein irradiation can be performed with a near infrared ray in a predetermined wavelength region to perform recording into the recording layer and deletion of the recording.

5. The reversible recording medium according to claim 1, wherein irradiation can be performed with a semiconductor laser to perform recording into the recording layer and deletion of the recording.

6. The reversible recording medium according to claim 1, wherein the coloring compound being represented by the following general formula (2):

(2)

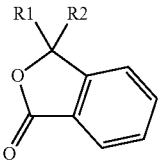

where R1 and R2, each independently, denote a phenyl group, an aminophenyl group, an indolyl group, a benzoindolyl group, a quinoline group, a naphthalene group, or an alkyl group, or a derivative thereof, or alternatively may be bonded to each other via carbon (C), nitrogen (N), oxygen (O), and sulfur (S) to form a condensed aliphatic ring or a condensed aromatic ring.

7. An exterior member having at least one surface provided with a reversible recording medium, the reversible recording medium comprising:

a support base; and a recording layer provided on the support base and reversibly changing between a recorded state and a deleted state, the recording layer including a photothermal conversion material including one or more of a compound having a phthalocyanine skeleton, a compound having a squarylium skeleton, a compound having a cyanine skeleton that includes, in a molecule, one or both of a counter ion of one of $SbF_6$, $PF_6$, $BF_4$, $ClO_4$, $CF_3SO_3$ and $(CF_3SO_3)_2N$ and a methine chain containing a five-membered ring or a six-membered ring, and an inorganic compound, and a mixture of three types of microcapsules including respective coloring compounds to be colored differently from one another and respective color developing/quenching agents corresponding to the respective coloring compounds, wherein the respective coloring compounds each comprise a coloring compound having an electron-donating property, and wherein the respective color developing/quenching agents each comprise a color developing/quenching agent having an electron-accepting property and including at least one compound represented by a following general formula (1):

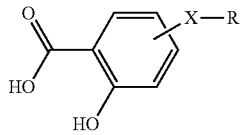

(1)

where X is one of —NHCO—, —CONH—, —NHCONH—, —CONHCO—, —NHNHCO—, —CONHNH—, —CONHNHCO—, —NHCOCONH—, —NHCONHCO—, —CONHCONH—, —NHNHCONH—, —NHCONHNH—, —CONHNHCONH—, —NHCONHNHCO— and —CONHNHCONH—, and R is a linear hydrocarbon group having 29 to 34 carbon atoms.

* * * * *